US006447411B1

(12) United States Patent
Bianchi

(10) Patent No.: US 6,447,411 B1
(45) Date of Patent: Sep. 10, 2002

(54) VIBRATION DAMPER USING A ROTARY MECHANISM FOR ALL TENNIS RACKETS

(76) Inventor: Jean-Claude Bianchi, 617, les Cabots, 06410 Biot (FR)

( * ) Notice: Subject to any disclaimer, the term of this patent is extended or adjusted under 35 U.S.C. 154(b) by 0 days.

(21) Appl. No.: 09/650,356

(22) Filed: Aug. 29, 2000

Related U.S. Application Data

(63) Continuation-in-part of application No. 09/497,531, filed on Feb. 4, 2000, now abandoned.

(30) Foreign Application Priority Data

Feb. 4, 1999 (FR) ..... 99 01308

(51) Int. Cl.[7] ..... A63B 49/00; A63B 51/00
(52) U.S. Cl. ..... 473/522
(58) Field of Search ..... 473/520, 521, 473/522, 523

(56) References Cited

U.S. PATENT DOCUMENTS

| | | | | | |
|---|---|---|---|---|---|
| 4,909,509 | A | * | 3/1990 | Boschian | 473/522 |
| 4,927,143 | A | * | 5/1990 | Hillock | 473/522 |
| 5,362,046 | A | * | 11/1994 | Sims | 473/523 X |
| 5,651,545 | A | * | 7/1997 | Nashif et al. | 473/520 |
| 5,655,980 | A | | 8/1997 | Nashif et al. | |
| 5,792,011 | A | * | 8/1998 | Kuebler | 473/520 |
| 5,871,409 | A | * | 2/1999 | Kimoto | 473/522 |
| 5,964,672 | A | * | 10/1999 | Bianchi | 473/521 |

FOREIGN PATENT DOCUMENTS

| | | | | |
|---|---|---|---|---|
| DE | 3504137 | | 8/1986 | |
| DE | 3521650 | * | 12/1986 | 473/FOR 171 |
| DE | 19531642 | | 3/1997 | |
| EP | 261994 | * | 3/1988 | 473/FOR 171 |
| EP | 0781 575 A2 | | 7/1997 | |
| FR | 2525113 | * | 10/1983 | 473/FOR 171 |
| FR | 2 789 320 | | 2/1999 | |
| FR | 2789320 | * | 8/2000 | A63B/49/00 |

OTHER PUBLICATIONS

Tecnifibre Cordage Officiel Roland Garros 2000; a picture of the system relating to Figs. 1–10 was published in Marcy 1999 with the price list of applicants dealer.

* cited by examiner

*Primary Examiner*—Raleigh W. Chiu
(74) *Attorney, Agent, or Firm*—Connolly Bove Lodge & Hutz, LLP; Larry J. Hume

(57) ABSTRACT

This invention is for an effective anti-vibration system that adapts to any tennis racket, comprising of a compact flexible element (1), that fixes onto the strings, here (3) and (4), or onto the frame of a tennis racket, using another rigid element (5) comprising of a protruding part (6). When hit by a ball, the protruding part (6) rotates and makes the interdependent part (5) pivot, which is restrained by the distortion of the elastomer element (1). The restrained rotation of the rigid unit (5) and (6) dissipates the vibratory energy of the racket.

7 Claims, 5 Drawing Sheets

VIBRATION DAMPER USING A ROTARY MECHANISM FOR ALL TENNIS RACKETS

CROSS-REFERENCE TO RELATED APPLICATION

FIELD OF THE INVENTION

The present application is a Continuation-In-Part of U.S. patent application Ser. No. 09/497,531, filed Feb. 4, 2000 and claims foreign priority to French Patent No. 99 01308 dated Feb. 4, 1999.

The present invention is a vibration damper system for any tennis racket or ball-game racket, made from flexible and rigid thermoplastic or thermosetting material that is inserted between the strings or onto the frame of a ball-game racket. The system absorbs the vibrations of the stringing and the frame that are caused by the impact of the ball.

DISCUSSION OF RELATED ART

The state of the previous techniques is given here in detail, in order to understand the technological progress made by the present invention. It is a well-known fact that an element made of elastomer or thermoplastic placed onto the strings of a racket absorbs the vibrations in the stringing. Lacoste's French patent no 1.308.833, filed in 1964, presented a vibration damper made from flexible material in the form of a toric shape, with grooves to fix it onto the stringing of the racket. Then, other systems arrived to perfect the Lacoste patent, such as the German patent DE 34 43 009 A 1, filed in 1984, and DE 35 04 137 A1, filed in February 1985. Both of these patents present systems that were made from elastomer, also toric shaped like in Lacostes patent, and which used a metallic mass creating a perpendicular oscillation over the plane of the stringing whilst the elastomer of the toric is flexible. According to the hardness of their elastomer parts, and the space between the strings of the racket, the systems oscillate at different frequencies.

Indeed, if the strings are spaced apart, the central part of the elastomer on which the metallic mass is attached is more flexible. As a result, the oscillations of the mass occur at a lower frequency. If the strings are closer together, the opposite occurs, i.e. the mass oscillates at a higher frequency. Since it is the oscillations of the metallic mass in phase with the vibrations of the racket that determine the efficiency of the vibration damper, these systems are not universal. The U.S. Pat. No. 5,651,545, based on the German patents mentioned above, proposes to change the metallic masses according to the frequencies that are required. The French patent no 2.585.257 filed in July 1985 is, again, a toric form with a counterweight, associated with a membrane system that is supposed to transmit the vibrations. However, beyond the fact that the movement of the counterweight is, inevitably, very small, the membrane connecting the said counterweight to the elastomer toric is compressed to a varying extent, depending on the spacing of the strings, and so the system is unable to efficiently absorb vibrations in all types of rackets. All of the systems known until now that comprise of a flexible element and a metallic mass oscillate very little, because the oscillation is always perpendicular to the plane of the racket stringing Therefore, their efficiency is limited, and only the vibrations of one type of racket, with a particular spacing of the strings, can be absorbed. None of the systems is intrinsically adjustable to oscillate in phase with the vibrations to be dampened in the racket. The present invention overcomes these drawbacks. In the first, preferred version, the invented device comprises of at least two elements. The first, in a compact form, made from a flexible material, is inserted between the strings of the racket, in the same way as in the Lacoste patent no 1.398.833 referred to above; the other element is more rigid, and is inserted inside, or fixed outside the flexible element, perpendicular to two strings of the racket. This second element comprises of a perpendicular protrusion, positioned between the two strings and pointing along the longitudinal axis of the said strings. When a ball hits the stringing, the resulting vibrations induce a perpendicular protrusion to move, causing the second element to rotate and dissipate the vibrations. Thus, the elastic pressure of the first elastomer element on the second, more rigid element, is constant, whatever the spacing of the strings. The frequency of the motion of the rotating part is identical, whatever the spacing of the strings, because its semi-rigid articulation is disconnected from the oscillations of the flexible element, which themselves are perpendicular to the stringing.

The movable, rotating part turns around its central axis, inserted into the flexible element. To avoid the system from coming detached from the stringing, the more rigid element has, at each end, an upper and lower protrusion, between which the strings are positioned. Eveni if the rotation of the rigid part is rather limited, the movement of the extremity of the protrusion is always much greater, and the system is attached perfectly to the strings. To accentuate the rotating effect of the rigid element, the protrusion of this element contains a metallic part with a hole, into which the more rigid part is inserted, which slots in between the strings. By adjusting the semi-rigid articulation with a twisting movement, the oscillation frequency can by set by rotating the movable element to the frequency of vibrations to be dampened. For this purpose, the movable part features a strip made from a semi-rigid material, close to the centre of rotation, that itself is articulated to rotate around the axis of the plane of the stringing, which overlaps the flexible elastomer adjacent to the first element. So, when the strip is positioned along the axis of the movable element, the resistance to bending of the latter, brought about by the compact flexible element inserted between the cords, remains unchanged.

But if the user, by rotating the strip, manually positions the strip perpendicularly to the movable part, that is by overlapping the first flexible element over the sides, the rigidity of the semi-rigid articulation of the movable part increases. Thus, depending on the position of the strip, the rotation frequency of the movable part can be modified and can be adapted more accurately to the frequency of vibration of the racket, to dampen the vibrations more efficiently. A variant uses a strip that slides along a rail, positive or negative, positioned on the visible surface of the movable element, parallel to its longest sides The strip is then positioned perpendicular to the longest sides of the movable element. By sliding the strip along the rail placed on the movable part, the extremities of the strip overlap the adjacent elastomer part, located on both sides of the movable element, and the rigidity of the semi-rigid articulation of the movable part is modified. By simple positioning the strip, the system can be adjusted perfectly to the vibrations that need to be dampened. Another variant allows the additional mass to be moved forwards or backwards in relation to the axis of rotation of the movable element. In this case, the said movable element includes a rail, onto which the additional mass is positioned. If the additional mass is inside the movable element, its housing is larger than the additional mass to be housed. The housing is pulled in parallel along the length of the movable element, i.e. in an eccentric direction in relation to the movable element. When the additional the axis of rotation of the movable element. In this case, the said movable element includes a rail, onto which the additional mass is positioned. If the additional mass is inside the movable element, its housing is larger than the additional mass to be housed. The housing is pulled in parallel along the length of the movable element, i.e. in an eccentric direction in relation to the movable element. When the additional mass moves closer or further from the centre of rotation, the movable element reduces or increases the vibration frequency of the movable element, enabling a precise adjustment of the vibration frequency to the vibration frequency of the racket to be dampened. In another variant of the system the elastomer element is fixed to the frame of the racket, which has a protrusion onto which the more rigid rotating part is fixed, with a hollow and/or an additional mass to increase the inertia of the said rigid element.

BRIEF DESCRIPTION OF THE DRAWINGS

The drawing shows several diagrams of two preferred realisations of the invention.

DESCRIPTION OF PREFERRED EMBODIMENTS

Figure 2:
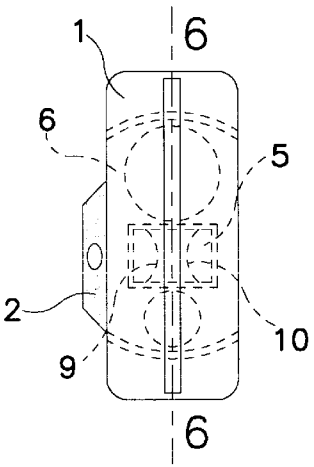
FIG. 2 shows the same system, seen from the side, along the longitudinal axis of the strings. Here, the strings have been omitted to simplify the drawing.
Figure 1:
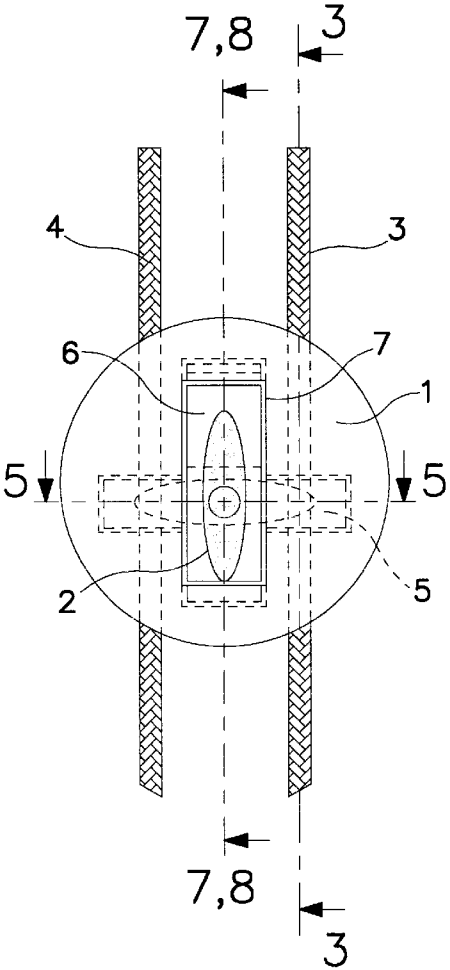
FIG. 1 shows the front view of the system fixed between two strings of a tennis racket.

Referring to FIG. 1, the compact device comprises here of a compact element (1), made from flexible elastomer material, fixed onto the strings (3) and (4). The rigid element (5), shown in skeleton form, comprises of an eccentric rotating protruding part (6) which takes position in an opening (7) which comprises of the element (1). The adjustment strip (2) allows the semi-rigid articulation of the rotating part to be stiffened, turned manually by 90° along axis (T) from the parallel plane of the stringing of the racket. comprises of an eccentric rotating protruding part (6) which takes position in an opening (7) which comprises of the element (1). The adjustment strip (2) allows the semi-rigid articulation of the rotating part to be stiffened, turned manually by 90° along axis (T) from the parallel plane of the stringing of the racket. In FIG. 2, it can be seen that the device is very compact, and that the adjustment strip (2) does not protrude much on the device.

Figure 3:
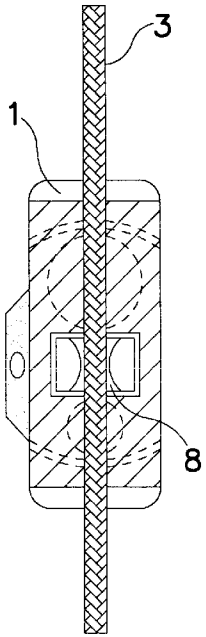
FIG. 3 shows a section along 3 of FIG. 1.

FIG. 3 shows a cross-section along the axis of a string. One can clearly see that the rigid pivoting part (5) comprises of a hollow (8) where the string (3) is positioned. The two parts, upper (9) and lower (10) of this housing (8) are rounded, so that the rigid part (5) can pivot. Notice also the space between the two upper (9) and lower (10) parts of the rigid element (5) is greater than the diameter of the string (4).

FIG. 3 is a side view along the transversal axis of the strings (3) and (4), showing the grooves (11) and (12) in which the strings (3) and (4) are inserted.

Figure 5B:
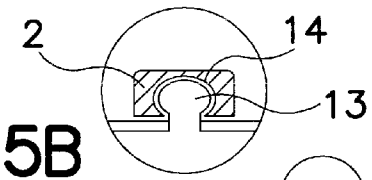
FIGS. 5A and 5B shows a cross-section along 5 of FIG. 1.
Figure 5A:
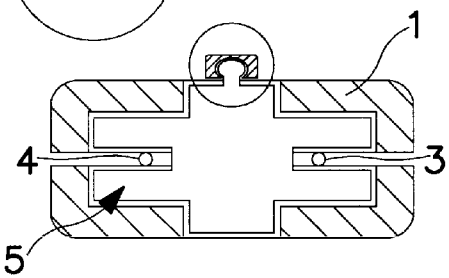

FIG. 5 is a cross-section along A.A. of the device in FIG. 1, which shows that the rigid part (5) has a small protrusion on its upper surface (13), into which the hollow (14) of the strip (2) is inserted. This system enables the strip to be pivoted manually.

Figure 6:
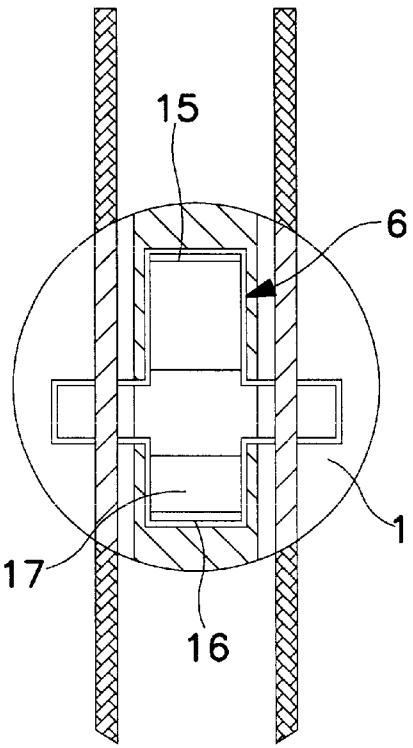
FIG. 6 shows a cross-section along 6 of FIG. 2.
Figure 4:
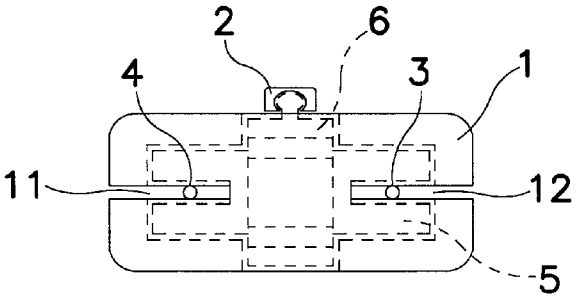
FIG. 4 shows the same system as FIG. 1, seen from the side, along the transverse axis of the strings.

FIG. 6 is a radial cross-section (C.C) of the device in FIG. 1, presenting more clearly the characteristics of the moving part. Notice the metallic part (15) fixed onto the moving protrusion (6) which gives weight to, and considerable increases the rotation effect of the rigid unit. On the opposite side, the other protrusion (16) is hollowed out (17) to make it lighter, so as not to slow down the inertia of part (6), comprising of the metallic part (15).

Figure 10:
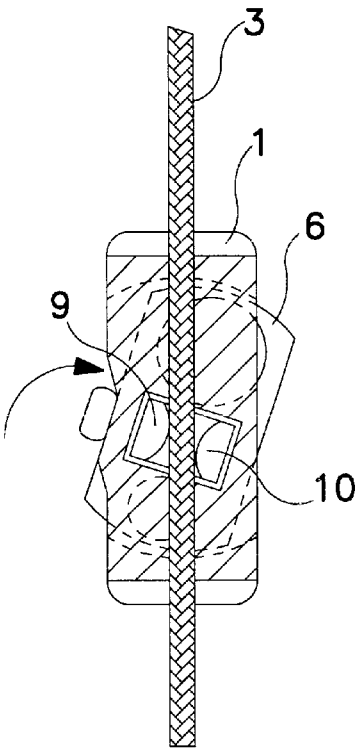
FIGS. 9 and 10 both show a cross-section along 7,8 of a system similar to the one in FIG. 1, but with the strip (2) turned in a different direction.
Figure 9:
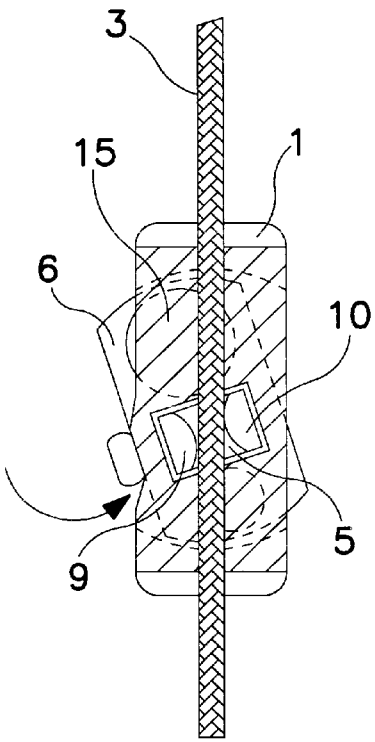
Figure 8:
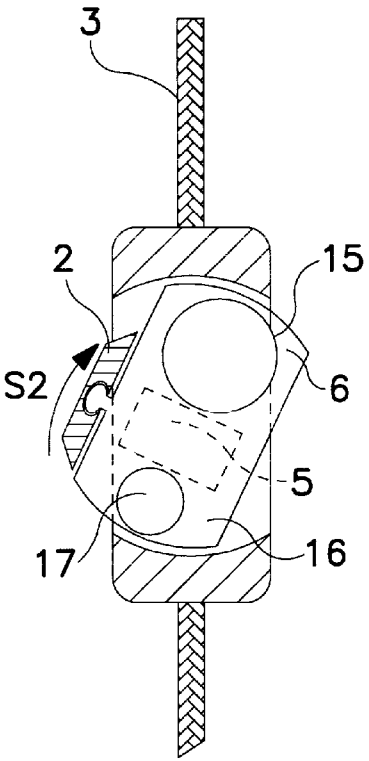
FIGS. 7 and 8 both show a cross-section along 7,8 of the system according to FIG. 1, but with the movable part off-centre, following an impact from a tennis ball on the stringing.
Figure 7:
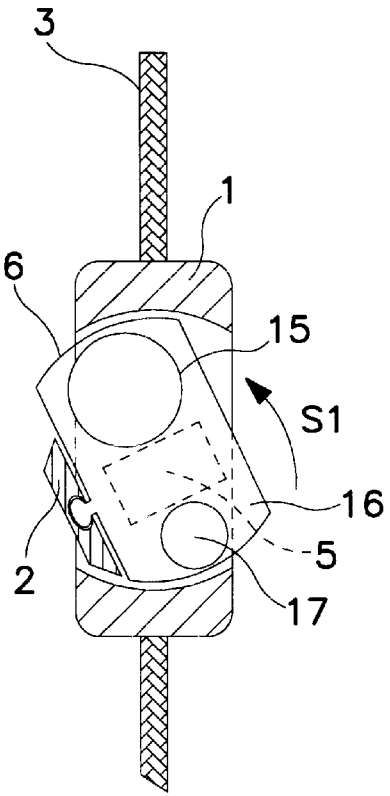
Figure 11:
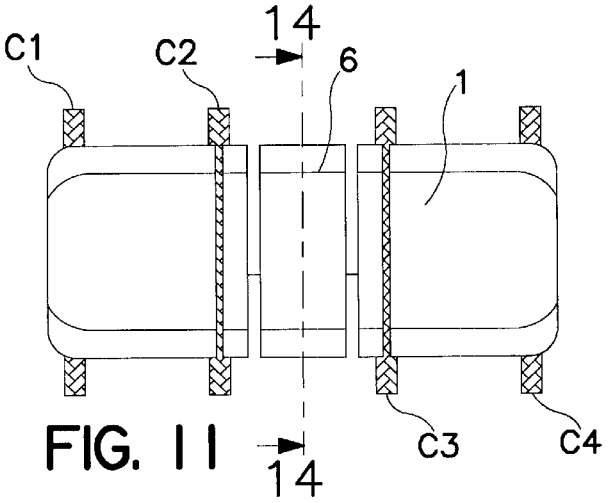
FIG. 11 shows a variant of the invention, seen from the front on the strings.
Figure 12:
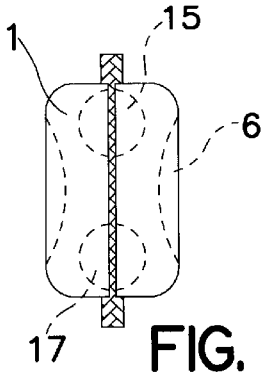
FIG. 12 presents the same variant, seen from one of its two small sides, in the axis of the plane formed by the strings with a simplified representation of the movable element drawn in dotted lines.
Figure 13:
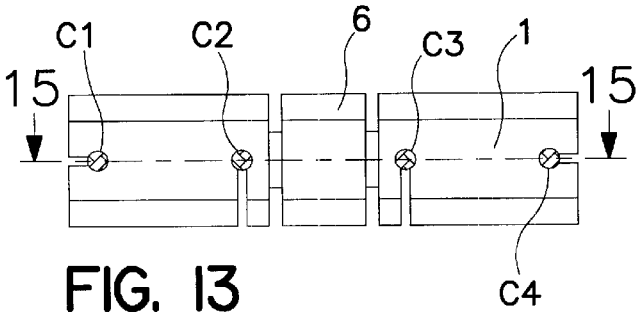
FIG. 13 again shows the same variant of the system, seen from above.
Figure 14:
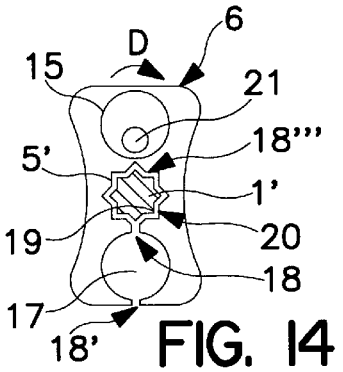
FIG. 14 shows a cross-section of the device along 14 of FIG. 11.
Figure 15:
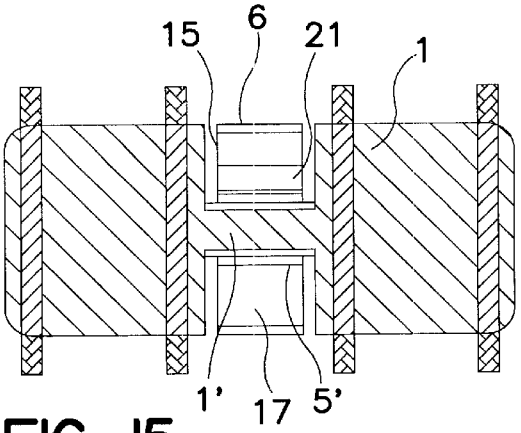
FIG. 15 shows a cross-section of the device along 15 of FIG. 13.

FIGS. 7 and 8, which are a cross-section along B'.B.') of the device in FIG. 1, show the rotation movement of the moving part, in the direction of the rotation (S1) for FIG. 7, and (S2) for FIG. 8. Notice of these figures the inertia mass (15), which here is cylindrical. The hollow (17) of part (16) is also cylindrical. FIGS. 9 and 10 are views of (B.B.) of the device in FIG. 1, but with the strip (12) pointing along the longitudinal axis of the rigid part (5), placed between the strings (3) and (4). These figures make it easier to understand how the strip (2) stiffens the semi-rigid articulation, and slows down the the moving part (6) by rotation. It is clearly visible that when the strip (2) overlaps the elastomer of the compact element (1) situated on the rigid part (5), the strip slows down the movement of the rotating part (6). But the movement of part (6) is not stopped completely, because the flexible elastomer of the element distorts. This distortion, shown by arrows on these figures, enables the protrusion (6), helped by the inertia induced by the impact of the ball of the metallic part (15), to move. The increased resistance to rotation of the movable part (5) and (6) allows such movable part to enter into phase with the lower frequencies, those in the frame of the racket, to dissipate the vibratory energy better. Notice also that thanks to their rounded shape, the upper (9) and lower (10) parts of the rigid element (5) enable this rigid element (and therefore the protrusion (6) which is fixed to it, to start rotating. the protrusion (6) which is fixed to it, to start rotating.

The variant of the realisation of the invention in FIGS. 11, 12, 13, 14, 15, 16 and 17 also represent an elastomer element (1) attached to four strings (C1, C2, C3, and C4) of a racket, equipped with a rigid element (6), moving in rotation. FIGS. 12, 14, 15 and 17 show that the rotating element has an additional mass (15) and a hollow (17), enabling a localised inertia of the said element (6), so as to make it rotate following an impact by a ball. This rotation of the element (6) which is slowed down by the distortion of the elastomer element (1') passing through the rigid element (6), dampens the vibrations. The grooves (18) and (18') enable the part (1') of the deformable elastomer to be inserted into the rigid part (6), which also distorts a little to increase the size of the grooves (18 and 18').

To adjust perfectly the inertia of the movable part (6), the external perimeter (19) of part (1') of the elastomer (1) and the internal perimeter of the hole (20) of the rigid part (5) are connected by notches. Thus, when element (6) is turned manually, forcing by one ore more notches, the notch connecting the elastomer part (1') and the rigid part (5) positions the said element (6) and its inertia mass (15) differently in relation to the elastomer part (6), which is fixed to the strings. The angle formed by the mass (15), the centre of the rotation axis and the axis of the plane of the stringing determines the value of the couple of the movable part (6). The lower this angle is, the greater will be the value of torque of the movable part (6), induced by the impact of the tennis ball.

As an appropriate value of this torque is necessary to dampen the vibrations, according to the vibratory mode of each racket in use, the various possibilities of adjustment allow the device to adapt to all types of racket, for an optimal absorption of the vibrations. To adapt the required torque value even more finely, the additional mass (15) has a hollow (21). By turning this cylindrical mass (15) in the direction (D) shown in FIG. 14, inside the cylindrical housing of the movable element (6), the value of the couple of the said olomont (6) is changed, in relation to its rotation axis. Obviously, the specificity of this mass (15) which has a hollow in it (21) can be used on all type of vibration dampening devices that use a rotary mechanism, like those shown in FIGS. 1 to 10 and 18 to 19. It is also clear that all types of connections that allow the movable part to rotate in relation to the part (1') of the elastomer element (1), such as smooth pressure mechanisms, or pin mechanisms, retractable or not, or even magnetic mechanisms, which can be included in the frame of this invention. In order to stiffen the flexing of part (1'), the element (1') comprises of a semi-rigid tubular part (5') around it external perimeter, which can stretch up to the strings (CS and C3). When the device is mounted onto a racket with closely positioned strings, this element (5') keeps the elastomer element (1), that is found on each side of the movable element (6), apart. Thus, there is no risk of the elastomer element (1) on each side of the movable element (6) of slowing down the said movable part (6) by contact. Element (5') features a slot (18"") enabling part (1') to be inserted.

Figure 16:
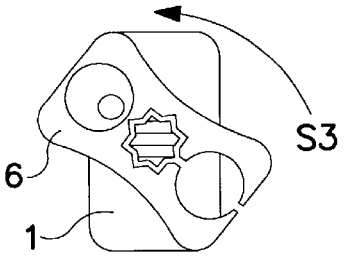
FIGS. 16 and 17 show the rotation of the movable part (6) with arrows (S3) and (S4).
Figure 17:
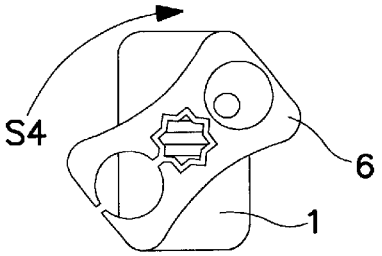

FIGS. 16 and 17 show the rotations that the movable part makes. Here, the rotations are alternately in one direction (S3) and in the other direction (S4) in relation to the elastomer part (1) fixed to the strings.

Figure 19:
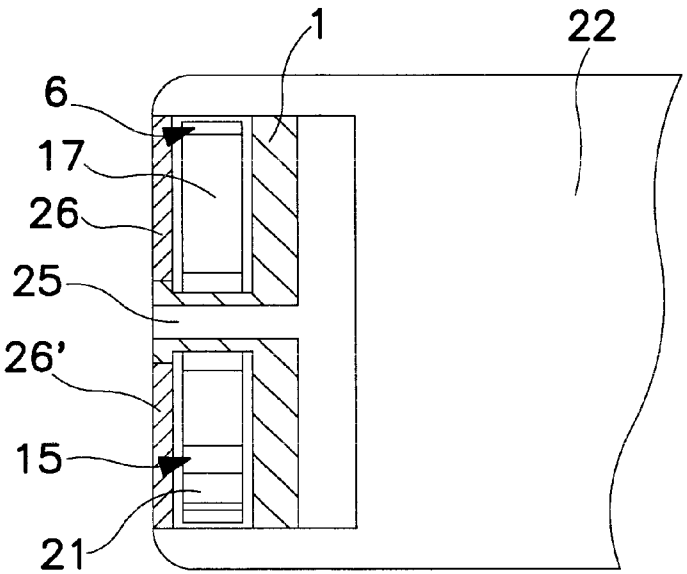
FIG. 19 is a cross-section, along 19 of FIG. 18 of the devise mounted on the shaft.
Figure 18:
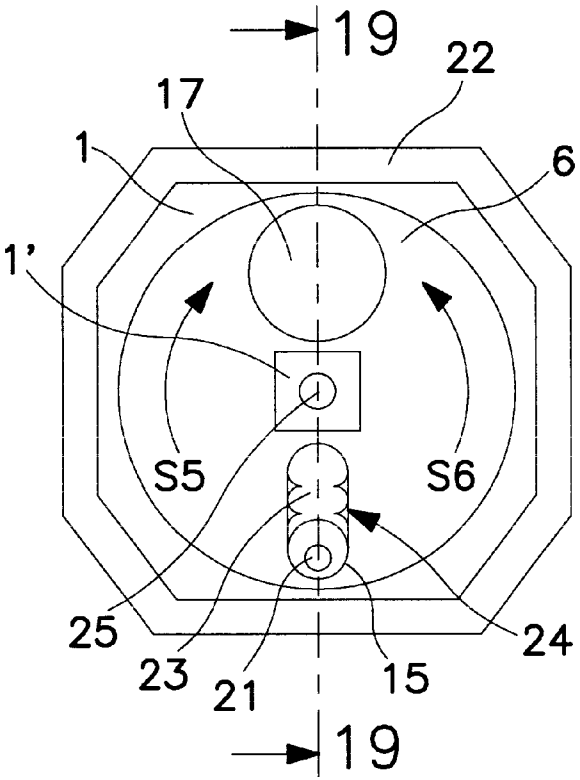
FIG. 18 shows another variant of the device with a rotating mechanism, mounted on the shaft of a tennis racket, seen here from the end of the shaft.

FIG. 18 shows a variant of the rotary mechanism, mounted onto the shaft of a tennis racket. Notice that the elastomer element (1), which here is snapped on and fixed to the end of the shaft (22) of a racket, supports the moving part (6) which here is in the form of a disk. It is clear that any means of fixation known today, such as glue or screws, can be used. The housing (23) that lodges the additional mass (15) extends by moving away from the centre of rotation. This housing (23) comprises of a notch (24) which enables the mass to be positioned at the required distance from the centre of rotation, to adapt the vibratory frequency to the system. The rotation of the movable part works in alternation, following (S5) and (S6) in relation of the elastomer (1), which remains fixed to the racket. FIG. 19, which is a cross-section of the rotary vibration damper mounted on the shaft of a tennis racket, shows how extremely compact the system is. Here, it is integrated into a hollow in the shaft (22), but it can also be placed in a cap on the end of the shaft. In this view, one can see a rigid axis (25), enabling part (1') to be stiffened, so that it distorts during rotation and not during flexion. Several disks, with different adjustments of masses (15) enable various frequencies of vibrations to be dampened. In FIG. 19, a cover (26 and 26'), here shown as a transparent material, have been added to protect the device from the player's hand. The device can be positioned in a tube, which can be placed in any ball game racket that has a cavity for this purpose.

The device in this invention can be manufactured by moulding, from supple or rigid plastic. The elastomer part (1) would preferably be made from a thermosetting material, less sensitive to softening than thermoplastic, under high ambient temperatures.

The dimensions of the parts of the device, notably the pivoting rigid element (5) and its rotary protrusion (6) mean that the materials do not need to be very hard. The metallic part (15) can be made on a lathe or by machining, or by cold heading cutting. Parts (5) and (6) may be two separate parts, in which case part (6) would have a hole allowing part (5) to be inserted through it. In the case of the variant illustrated in FIGS. 11 to 19, the part (6) can be made in two parts, which would be assembled by connecting part (1') and the elastomer (1). The pivot (25) can be made from metal or plastic.

It is clear that the realisations in the drawings are given for information purposes only. All the variations of form of a device enabling the association of an element that is fixed onto the stringing or the frame of a tennis racket or any other ball game racket with a movable part, moving in rotation around an axis, to dampen the vibrations following the impact of a ball, shall stay within the frame of the invention.

The present invention is especially intended to dampen vibrations on all types of ball game rackets.

What I claim is:

1. A vibration damper device for a tennis racket made from compact, flexible material inserted between strings or stringing of the tennis racket, or onto or into a frame of the tennis racket, the device comprising:

a moveable element assembled from rigid material moving in rotation to dampen vibrations following an impact by a tennis ball onto the stringing, wherein the moveable element comprises an assembled metallic mass, wherein said metallic mass increases an inertia of the tennis racket.

2. A vibration damper device for a tennis racket made from compact, flexible material inserted between strings or stringing of the tennis racket, or onto or into a frame of the tennis racket, the device comprising:

a moveable element assembled from rigid material moving in rotation to dampen vibrations following an impact by a tennis ball onto the stringing, wherein said device is positioned on the strings, the moveable element including a strip articulated along an axis of a plane of the stringing, wherein a rotation and a movement of the strip enables a stiffness and/or an amplitude of the movable element to be adjusted to adapt a frequency of the vibrations to the tennis racket to be dampened.

3. A vibration damper device for a tennis racket made from compact, flexible material inserted between strings or stringing of the tennis racket, or onto or into a frame of the tennis racket, the device comprising:

a moveable element assembled from rigid material moving in rotation to dampen vibrations following an impact by a tennis ball onto the stringing, wherein said device is positioned on the strings, the movable element including an articulated strip positioned perpendicular to a length of the movable element, wherein ends of the articulated strip overlap an adjacent elastomer part situated on each side of the movable element, wherein, by moving the articulated strip, a stiffness and/or an amplitude of the moveable element is adjusted to adapt a frequency of the movable element to the vibrations of the racket to be dampened.

4. A vibration damper device for a tennis racket made from compact, flexible material inserted between strings or stringing of the tennis racket, or onto or into a frame of the tennis racket, the device comprising:

a moveable element assembled from rigid material moving in rotation to dampen vibrations following an impact by a tennis ball onto the stringing, wherein an external perimeter of an elastomer element and an internal perimeter of the movable element includes a connection that enables a value of a torque of the movable element to be modified following the impact by the tennis ball on the stringing.

5. A vibration damper device for a tennis racket made from compact, flexible material inserted between strings or stringing of the tennis racket, or onto or into a frame of the tennis racket, the device comprising:

a moveable element assembled from rigid material moving in rotation to dampen vibrations following an impact by a tennis ball onto the stringing, wherein the movable element includes an additional mass having a hollow portion therein which enables the device to be adjusted in relation to the vibrations to be dampened, wherein the device is adjusted by turning the additional mass in a clockwise direction.

6. A vibration damper device for a tennis racket made from compact, flexible material inserted between strings or stringing of the tennis racket, or onto or into a frame of the tennis racket, the device comprising:

a moveable element assembled from rigid material moving in rotation to dampen vibrations following an impact by a tennis ball onto the stringing, wherein the moveable element includes an additional mass which is either moved closer to or further from a center of rotation of the movable element to adjust the device to the vibrations to be dampened.

7. A vibration damper device for a tennis racket made from compact, flexible material inserted between strings or stringing of the tennis racket, or onto or into a frame of the tennis racket, the device comprising:

a moveable element assembled from rigid material moving in rotation to dampen vibrations following an impact by a tennis ball onto the stringing; and a plurality of moving parts, wherein each moving part of the plurality of moving parts is arranged with respect to the moveable element and adjusted to correspond to a frequency corresponding to a particular vibration to be dampened.

* * * * *